US005423157A

United States Patent [19]

Watanabe

[11] Patent Number: 5,423,157

[45] Date of Patent: Jun. 13, 1995

[54] LONGITUDINALLY ASSEMBLED ROOF STRUCTURE AND METHOD FOR MAKING SAME

[75] Inventor: Satoru Watanabe, Kanagawa, Japan

[73] Assignee: Gantan Beauty Industry Co., Ltd., Japan

[21] Appl. No.: 120,884

[22] Filed: Sep. 13, 1993

[30] Foreign Application Priority Data

Sep. 14, 1992 [JP] Japan ..... 4-269085

[51] Int. Cl.[6] ..... E04B 1/00

[52] U.S. Cl. ..... 52/745.08; 52/747; 52/461; 52/464; 52/468

[58] Field of Search ..... 52/410, 408, 460, 461, 52/463, 464, 466, 468, 745.05, 745.06, 745.08, 747, 748

[56] References Cited

U.S. PATENT DOCUMENTS

| | | | |
|---|---|---|---|
| 2,907,287 | 10/1959 | Trostle | 52/461 X |
| 3,327,443 | 6/1967 | Gay et al. | 52/460 |
| 3,603,056 | 9/1971 | Roth | 52/460 |
| 4,271,651 | 6/1981 | Sorrells, Jr. | 52/460 |
| 4,590,730 | 5/1986 | Blendick | 52/466 X |
| 4,655,020 | 4/1987 | Ginn, Jr. | 52/545 X |

*Primary Examiner*—Lanna Mai

*Attorney, Agent, or Firm*—Stroock, Stroock & Lavan

[57] ABSTRACT

A longitudinally assembled roof structure capable of exhibiting increased strength against a wind pressure and preventing rainwater from entering connection regions between the roof plates due to a capillary action and blowing of rainstorm against the connection regions. A plurality of the roof plates which are formed into a predetermined length in a longitudinal direction are longitudinally connected to each other, to thereby assemble the roof structure. The roof plates include a flat plate body, lateral rising connection sections provided on both lateral sides of the plate body, and longitudinal connection sections provided on both longitudinal ends of the plate body. The longitudinal connection sections include an eaves side connection section and a ridge side connection section, wherein the ridge side connection section includes a downwardly oblique portion and a support portion outwardly extending from the downwardly oblique portion and the eaves side connection section includes an engagement portion formed by inwardly folding an eaves side end of the plate body to define a gap therein. Each of joints is fixedly positioned on the support portion of ridge side one of the longitudinally adjacent roof plates. Also, the joint is engaged at an eaves side engagement portion thereof with the engagement portion of the eaves side connection section of ridge side one of the longitudinally adjacent roof plates. A cover member is put on the connection region between the laterally adjacent roof plates are connected through the longitudinal connection sections to each other, and then is connected through an overlap portion thereof to a cover member adjacent thereto in a ridge side direction.

14 Claims, 15 Drawing Sheets

LONGITUDINALLY ASSEMBLED ROOF STRUCTURE AND METHOD FOR MAKING SAME

BACKGROUND OF THE INVENTION

This invention relates to a longitudinally assembled roof structure and a method for making the same, and more particularly to a longitudinally assembled roof structure constructed of roof plates for longitudinal roofing which are formed into a predetermined length in an eaves-ridge direction or longitudinal direction and a method for making the same.

The words "longitudinal direction", "longitudinal" and "longitudinally" used herein in connection with a roof, a roof structure, roofing, a roof plate and the like each indicate an eaves-ridge direction, or a direction extending from eaves of a roof to a ridge thereof or from the ridge to the eaves and the words "lateral direction", "lateral" and "laterally" indicate a direction perpendicular to the longitudinal direction.

A roof plate is generally classified into a roof plate for longitudinal roofing and that for lateral roofing.

The roof plate for longitudinal roofing is formed into a substantially rectangular shape, as well as a predetermined length in the longitudinal direction. A plurality of such roof plates for longitudinal roofing thus formed are connected to each other according to any one of two roofing or assembling procedures, resulting in forming a longitudinally assembled roof structure. One of the procedures is so carried out that the roof plates for longitudinal roofing are connected to each other in order in the lateral direction by means of fixtures to form a first or lowermost lateral-extending roof plate row and then a second or next laterally-extending roof plate row which is longitudinally adjacent to the first roof plate row is likewise formed while longitudinally connecting the roof plates of the first roof plate row formed to the roof plates of the second one being formed which positionally correspond to each other in the longitudinal direction. In this roofing or assembling procedure, the above-described operations are successively repeated in a ridge direction, to thereby assemble a roof structure.

The other roofing or assembling procedure is carried out in such a manner that a plurality of the roof plates for longitudinal roofing are longitudinally connected to each other in turn to form a first or outermost roof plate row longitudinally extending. Then, a second or next longitudinally extending roof plate row is likewise formed and thereafter the roof plate rows which are thus formed and laterally adjacent to each other are laterally connected to each other. In the second procedure, the above-described operations are successively repeated, resulting in a roof being assembled.

Longitudinal connection between the roof plates may be carried out in such a manner as disclosed in Japanese Utility Model Application Laid-Open Publication No. 134123/1990. More particularly, a roof plate includes a substantially flat plate body provided with a ridge side engagement, which is formed with a plurality of strip-like projections. The strip-like projections are overlappedly engaged with an eaves side engagement portion of a roof plate which is adjacently arranged in a ridge direction to longitudinally connect both adjacent roof plates to each other. Also, Japanese Patent Application Laid-Open Publication No. 86615/1989 and Japanese Patent Application Laid-Open Publication No. 8444/1990 each disclose another longitudinal connection between roof plates for longitudinal roofing in which longitudinal connection ends of each of the roof plates each are provided with a level different portion. The connection is carried out by means of a tongue-like element, through which longitudinally adjacent roof plates are overlapped each other for the longitudinal connection. Also, a joint made of a rubber material is incorporated in a space defined in the level different portions overlapped, to thereby ensure water-tightness at a longitudinal connection region between the roof plates.

Nevertheless, the prior art causes rainwater to easily enter the connection region through the overlapped portion, because both roof plates are merely connected by overlapping.

Also, the above-described longitudinal connection carried out by overlapping between the roof plates through the level different portion causes a level difference to be formed on the appearance of a roof structure assembled, to thereby fail to form a planar roof surface, as indicated in Japanese Patent Application Laid-Open Publication No. 194244/1990 which discloses a roof plate for longitudinal roofing. More particularly, the longitudinal connection, when rain and wind blow against the longitudinal connection region, causes rainwater to enter the connection region. This is substantially promoted by the level different portion at the longitudinal connection region because the level difference portion causes a slope or pitch of a roof structure to be at least locally reduced. In particularly, when the pitch is gentle, the level different portion often causes the pitch to be reverse. Thus, it is required to set a pitch of a roof structure sufficient to prevent back draft of a roof due to the level different portion.

Further, the roof plate disclosed in Japanese Patent Application Laid-Open Publication No. 194244/1990 fails to permit a longitudinal connection region between the roof plates to exhibit sufficient strength against a wind pressure, so that an eaves side end of each of the roof plates is lifted by rainstorm to form a gap therebetween, resulting in leakage of rainwater through the gap thus formed. In addition, the eaves side end of the roof plate is formed into a height smaller than each of lateral rising connection sections thereof, to thereby cause a gap to be formed due to a difference in height therebetween, resulting in leakage of rainwater through the gap. Thus, the roof plate of the Japanese publication fails to exhibit satisfactory water-tightness.

SUMMARY OF THE INVENTION

The present invention has been made in view of the foregoing disadvantage of the prior art.

Accordingly, it is an object of the present invention to provide a longitudinally assembled roof structure which is capable of exhibiting satisfactory water- or rain-tightness and durability.

It is another object of the present invention to provide a longitudinally assembled roof structure which is capable of exhibiting strength against or resistance to a wind pressure.

It is a further object of the present invention to provide a longitudinally assembled roof structure which is capable of preventing penetration of rainwater through a connection region between roof plates into the structure due to a capillary action and blowing of rainwater against the structure.

It is still another object of the present invention to provide a method for making a longitudinally assembled roof structure which is capable of providing a longitudinally assembled roof structure capable of exhibiting satisfactory water- or rain-tightness and durability.

It is yet object of the present invention to provide a method for making a longitudinally assembled roof structure which is capable of providing a longitudinally assembled roof structure capable of exhibiting strength against or resistance to a wind pressure.

It is a still further object of the present invention to provide a method for making a longitudinally assembled roof structure which is capable of providing a longitudinally assembled roof structure capable of preventing penetration of rainwater through a connection region between roof plates into the structure due to a capillary action and blowing of rainwater against the structure.

In accordance with one aspect of the present invention, a longitudinally assembled roof structure is provided. The roof structure comprises a plurality of roof plates each formed into a predetermined length in a longitudinal direction of the roof structure and a joint for connecting each longitudinally adjacent two of the roof plates to each other. Each laterally adjacent two of the roof plates are laterally connected to each other through a connection region defined therebetween. The roof structure also includes cover members which are put on the connection regions between the roof plates laterally adjacent, respectively, and adapted to be longitudinally connected to each other. The roof plates each include a plate body, lateral rising connection sections provided on both lateral sides of the plate body and longitudinal connection sections provided on both longitudinal ends of the plate body, wherein the longitudinal connection sections include an eaves side connection section and a ridge side connection section. The ridge side connection section includes a downwardly oblique portion and a support portion extending in a ridge side direction from the downwardly oblique portion and the eaves side connection section includes an engagement portion formed by downwardly folding an eaves side end of the plate body and adapted to be overlapped on the support portion of the ridge side connection section of the roof plate adjacent in an eaves side direction of the roof structure. The joint includes an engagement portion formed so as to be engageable with at least said engagement portion of the eaves side connection section of the plate body and the cover member is provided on a ridge side thereof with an overlap portion. The joint is arranged on the support portion of the ridge side connection section of the plate body and engaged at the engagement portion thereof with the engagement portion of the ridge side connection section of the roof plate adjacent in a ridge side direction of the roof structure. The cover members longitudinally adjacent to each other are connected through the overlap portions thereof to each other in turn.

In a preferred embodiment of the present invention, the engagement portion of the eaves side connection section is folded so as to define a gap therein.

In a preferred embodiment of the present invention, the engagement portion of the joint is inserted into the gap of the engagement portion of the eaves side connection section.

In a preferred embodiment of the present invention, the joint is formed into substantially the same side configuration as a cross section of the support portion of the ridge side connection section of the roof plate.

In a preferred embodiment of the present invention, the joint includes an elongated joint body formed so as to laterally extend, and a lateral rising section formed on each of both lateral ends of said joint body.

In a preferred embodiment of the present invention, the lateral rising section includes a first rising portion and a second rising portion upwardly extending from the first rising portion.

In a preferred embodiment of the present invention, the first and second rising portions are connected to each other through a horizontal portion formed so as to outwardly extend between an upper end of the first rising portion and a lower end of the second rising portion.

In a preferred embodiment of the present invention, the joint further includes a positioning member provided on the lateral rising section.

In a preferred embodiment of the present invention, the joint further includes an extension formed so as to outwardly extend beyond each of the lateral connection sections of the roof plate and fixed with respect to the roof plate.

In a preferred embodiment of the present invention, the joint body of the joint is provided thereon with a reinforcing rib in a manner to laterally continuously extend between both lateral rising sections of the joint.

In a preferred embodiment of the present invention, the joint body is provided at a central portion of a rear surface thereof with a pair of drainage grooves extending in a direction perpendicular to a longitudinal direction of the joint in a manner to be positionally symmetric to each other.

In a preferred embodiment of the present invention, the drainage grooves each are formed stepwise in a horizontal direction.

In accordance with another aspect of the present invention, a method for making a longitudinally assembled roof structure is provided. The method comprises the step of arranging a plurality of roof plates adjacent to each other in at least a longitudinal direction on a backing member.

The roof plates each are formed into a predetermined length in a longitudinal direction of the roof structure and include a plate body, lateral rising connection sections provided on both lateral sides of the plate body and longitudinal connection sections provided on both longitudinal ends of the plate body, wherein the longitudinal connection sections include an eaves side connection section and a ridge side connection section. The ridge side connection section includes a downwardly oblique portion and a support portion extending in a ridge side direction from the downwardly oblique portion and the eaves side connection section includes an engagement portion formed by downwardly folding an eaves side end of the plate body and adapted to be overlapped on the support portion of the ridge side connection section of the roof plate adjacent in an eaves side direction of the roof structure. The method also comprises the step of positioning a joint on the support portion of the ridge side connection section of ridge side one of each longitudinally adjacent two roof plates. The joint includes an engagement portion adapted to be engageable with at least the engagement portion of the eaves side connection section of the roof plate. Also, the method comprises the steps of engaging the engagement portion of the join with the engagement portion of the eaves side connection section of ridge side one of each longitudinally adjacent two roof plates and putting cover members on lateral connection regions between the roof plates laterally adjacent to each other. The cover members each are provided on a ridge side thereof with an overlap portion. Further, the method comprises the step of connecting the cover members to each other through the overlap portions in the longitudinal direction.

In a preferred embodiment of the present invention, the joint is previously mounted on said roof plate.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Now, a roof plate for longitudinal roofing according to the present invention will be described hereinafter with reference to the accompanying drawings.

Figure 1:
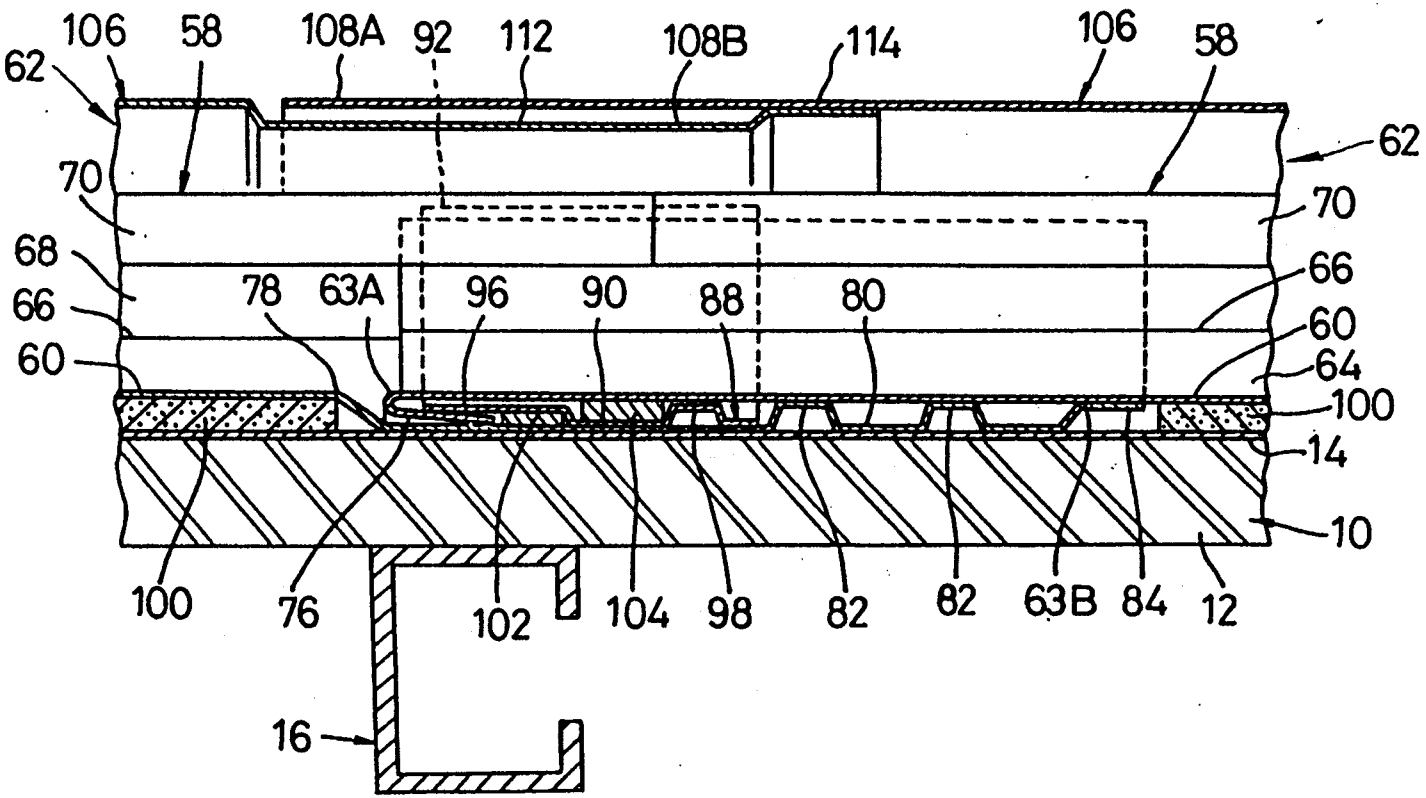
FIG. 1 is a fragmentary sectional view showing an essential part of a roof including a roof plate for longitudinal roofing according to an embodiment of the present invention, in which a plurality of the roof plates are connected to each other in order in an eaves-ridge or longitudinal direction.
Figure 2:
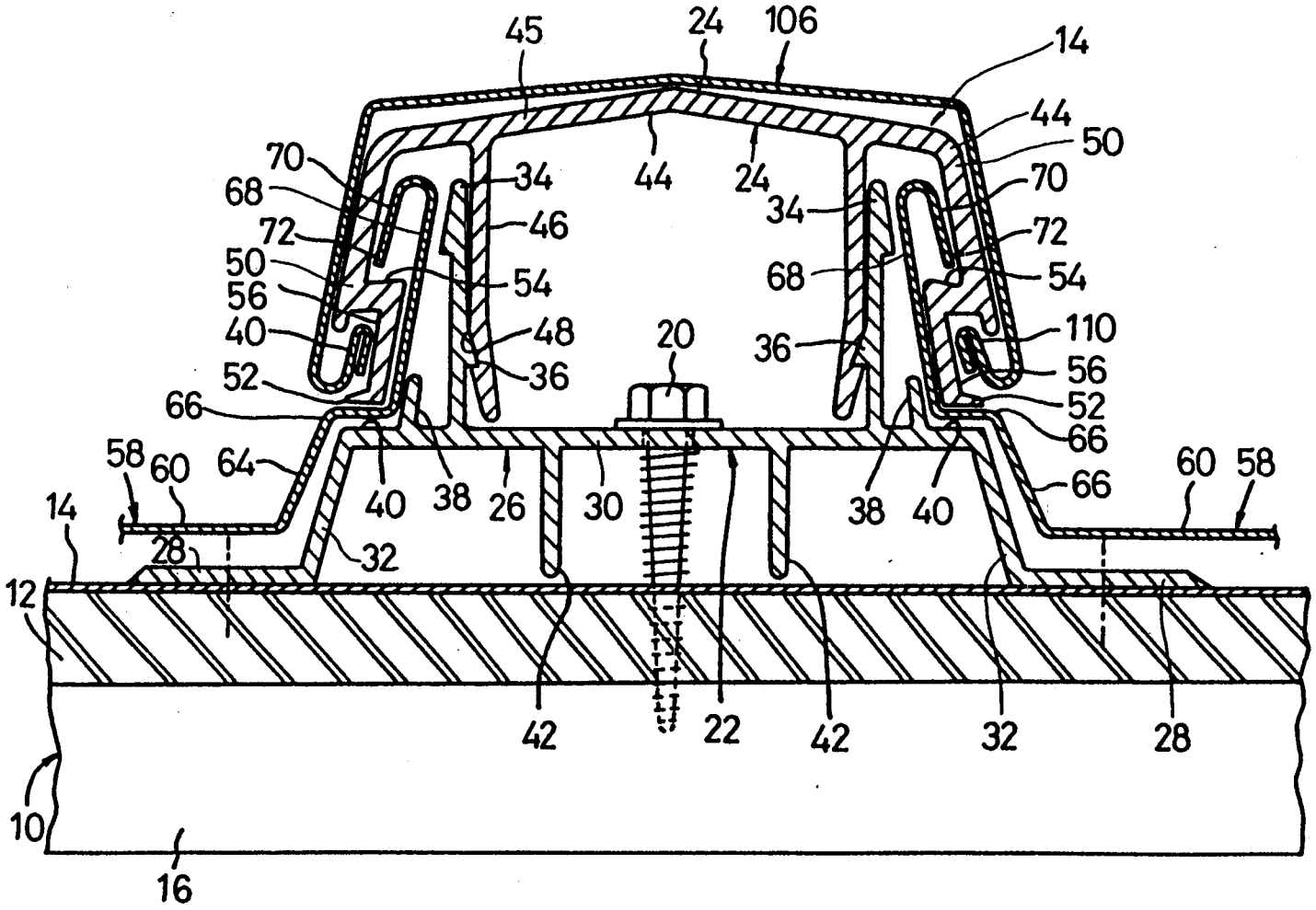
FIG. 2 is a fragmentary vertical sectional view showing lateral connection between roof plates according to an embodiment of the present invention which are connected in a lateral direction by means of a fixture combination.
Figure 3:
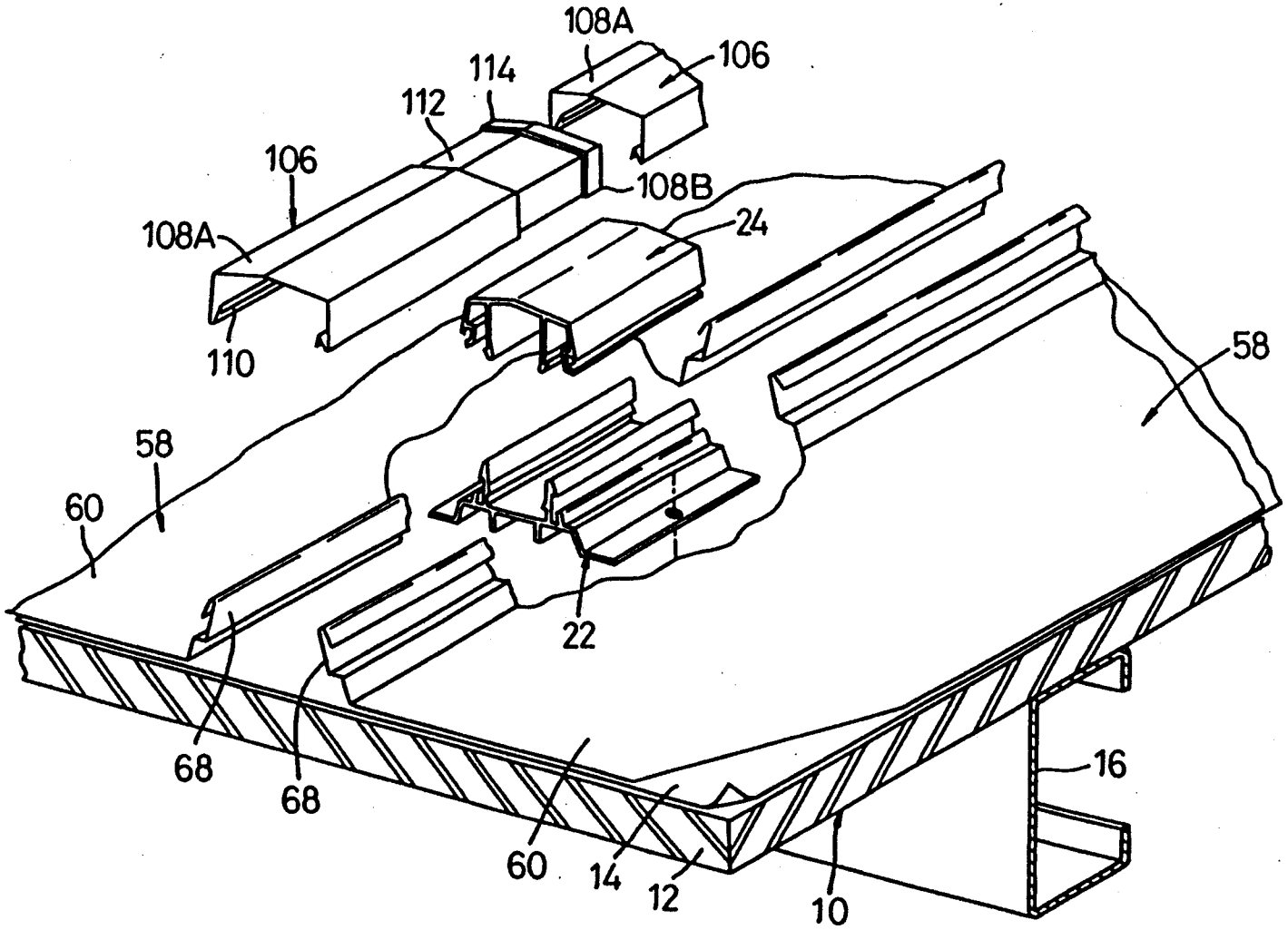
FIG. 3 is a fragmentary exploded perspective view of the lateral connection shown in FIG. 2.

Referring first to FIGS. 1 to 3, an embodiment of a roof plate for longitudinal roofing according to the present invention is illustrated. A roof plate of the illustrated embodiment is formed in a manner to be substantially laterally symmetric and into a predetermined length in an eaves-ridge or longitudinal direction. A plurality of the roof plates thus formed are connected to each other in turn in the longitudinal direction as shown in FIG. 1 for the purpose of forming or assembling a roof structure. Also, a plurality of the roof plates of the illustrated embodiment laterally adjacent to each other are connected to each other in a lateral direction perpendicular to the longitudinal direction for the purpose of assembling the roof structure.

In FIGS. 1 to 3, reference numeral 10 designates a backing member, which may be constructed of a sheathing board 12 such as an excelsior board and a waterproof material 14 such as an asphalt roofing material which are laid on a purlin 16 formed of, for example, a C-shaped steel material. The backing member 10 is fixedly mounted thereon with at least one fixture means or fixture combination 18 using a securing means 20 such as a screw, a bolt or the like which is fixed through the sheathing board 12 to the purlin 16. The fixture combination 14 serves to laterally connect the roof plates 58 laterally adjacent to each other therethrough and includes a lower fixture 22 fixed on the backing member 10 through the securing means 20 and an upper fixture 24 adapted to be engagedly fitted on the lower fixture 22. The upper and lower fixtures 22 and 24 each are formed in a substantially laterally symmetric manner and may be formed of any suitable material such as aluminum, aluminum alloy, hard resin or the like into an extruded shape of a short length.

Figure 4:
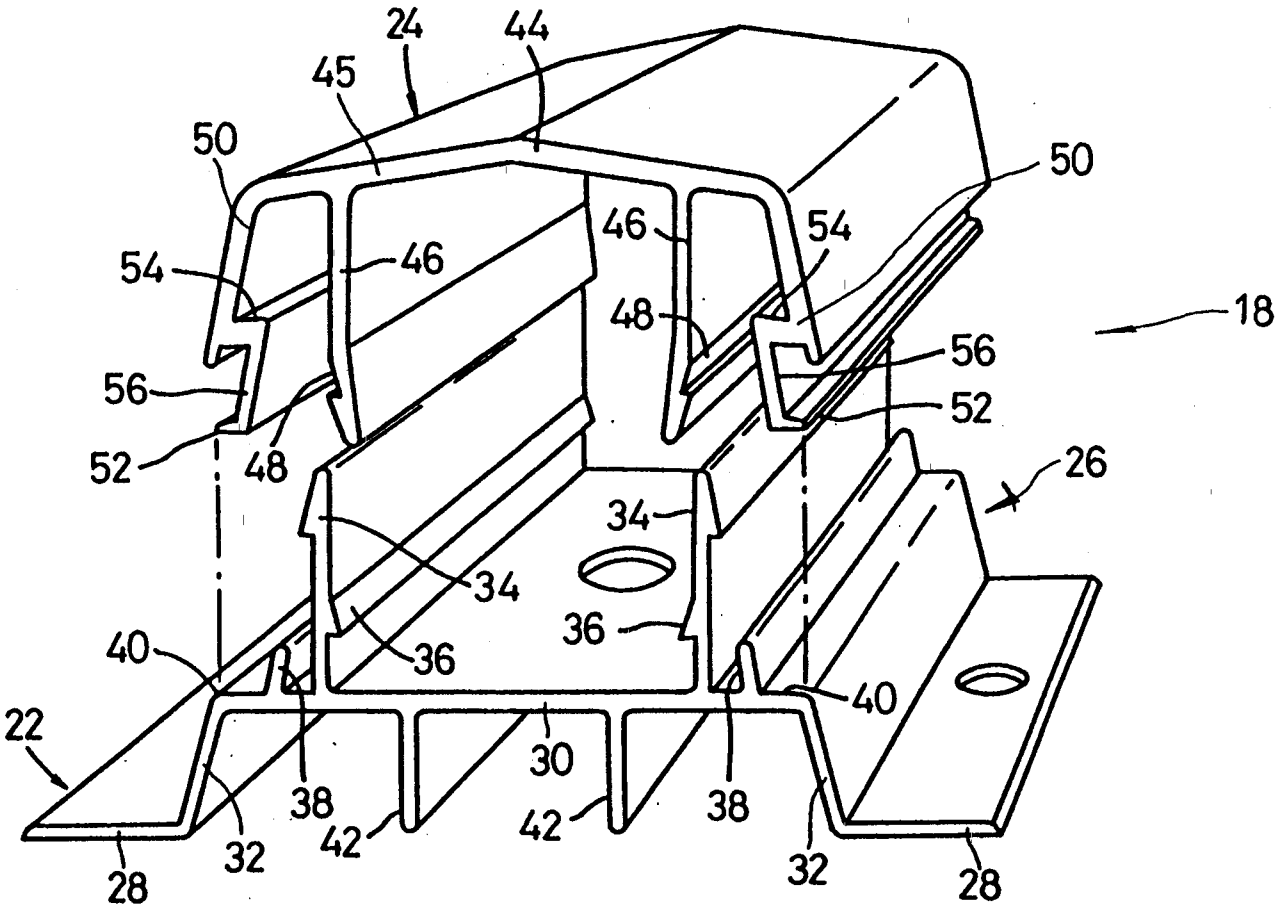
FIG. 4 is an exploded perspective view showing a fixture combination of an upper fixture and a lower fixture.

The lower fixture 22, as shown in FIG. 4, includes a base 26 arranged on the backing member 10 and fixed thereon. The base section 26 is formed into a substantially angular Ω shape, resulting in including a pair of flanges 28, a flat top portion 30, and a pair of legs 32 through which the flanges 28 and top portion 30 are connected to each other. The flat top portion 30 is provided on an upper surface thereof with a pair of upwardly projecting plate-like holders 34 in a manner to be spaced from each other in a lateral direction of the top portion 30 and extend in a longitudinal direction thereof. The holders 34 each are formed on an inner side thereof with a pawl-like stopper 36. Also, the flat top portion 30 is provided on the upper surface thereof with a projection 38 so as to be positioned outside each of the stoppers 36, which projections 38 are formed so as to extend in the longitudinal direction of the flat top portion 30 and upwardly inwardly project at substantially the same angle as an oblique angle Θ of each of lateral rising connection sections of a roof plate described below. A part of the flat top portion 30 between each of lateral ends of the flat top portion 30 and each of the projections 38 constitutes a shoulder 40. The flat top portion 30 is provided on a lower surface thereof with a plurality of reinforcing ribs 42 for reinforcing the flat top portion 30 and therefore the lower fixture 24 to prevent deformation of the fixture 34.

The upper fixture 24 includes a fixture body 44 which is formed into a substantially inverted U-shape so as to be fitted on the lower fixture 22 for covering the lower fixture 22. The fixture body 44 of the upper fixture 24 is provided on a lower surface of a top portion 45 thereof with a pair of plate-like projections 46 so as to be fitted between the holders 34 of the lower fixture 22 when the upper fixture 24 is fitted on the lower fixture 22. The plate-like projections 46 each are formed so as to downwardly project from the fixture body 44 and extend in a longitudinal direction of the fixture body 44. The projections 46 each are formed on an outside thereof with a recess 48, which is adapted to be fittedly engaged with the stopper 36 of each of the holders 34 of the lower fixture 22 when the upper fixture 24 is fitted on the lower fixture 22. The fixture body 44 also includes a pair of leg portions 50 downwardly extending from both ends of the top portion 45, each of which leg portions 50 is provided on a lower end thereof with an abutment 52 in a manner to positionally correspond to the shoulder 40 of the flat top portion 30 of the lower fixture 22. Also, the leg portions 50 of the upper fixture 24 each are so formed that a part thereof is inwardly projected as indicated at reference 54 in FIGS. 2 and 4, resulting in an outer side of each of the leg portions 50 being formed with a groove 56 extending in the longitudinal direction of the upper fixture 24. The projections 54 each may be formed so as to horizontally extend.

Figure 5:
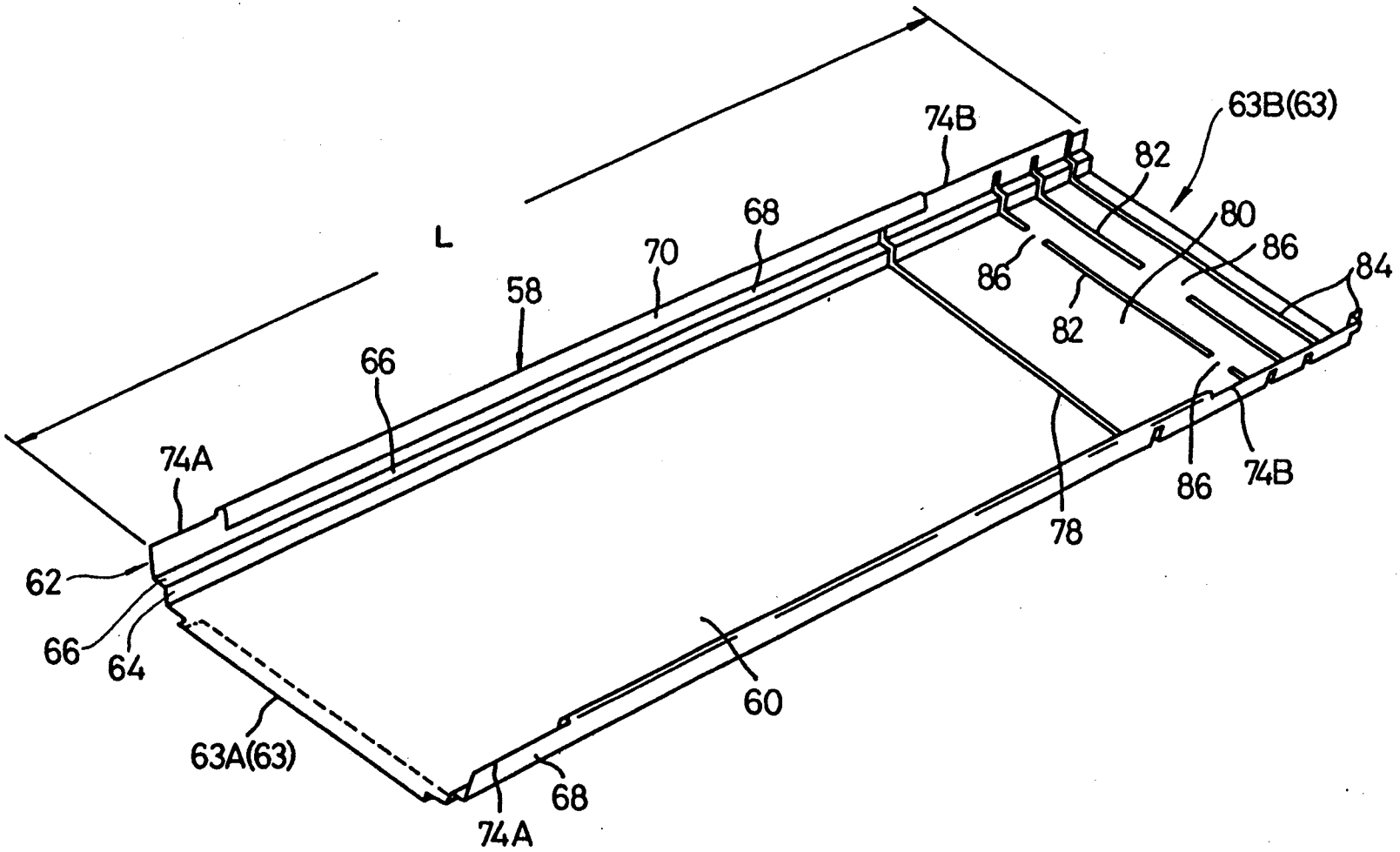
FIG. 5 is a perspective view showing an embodiment of a roof plate for longitudinal roofing according to the present invention.
Figure 6:
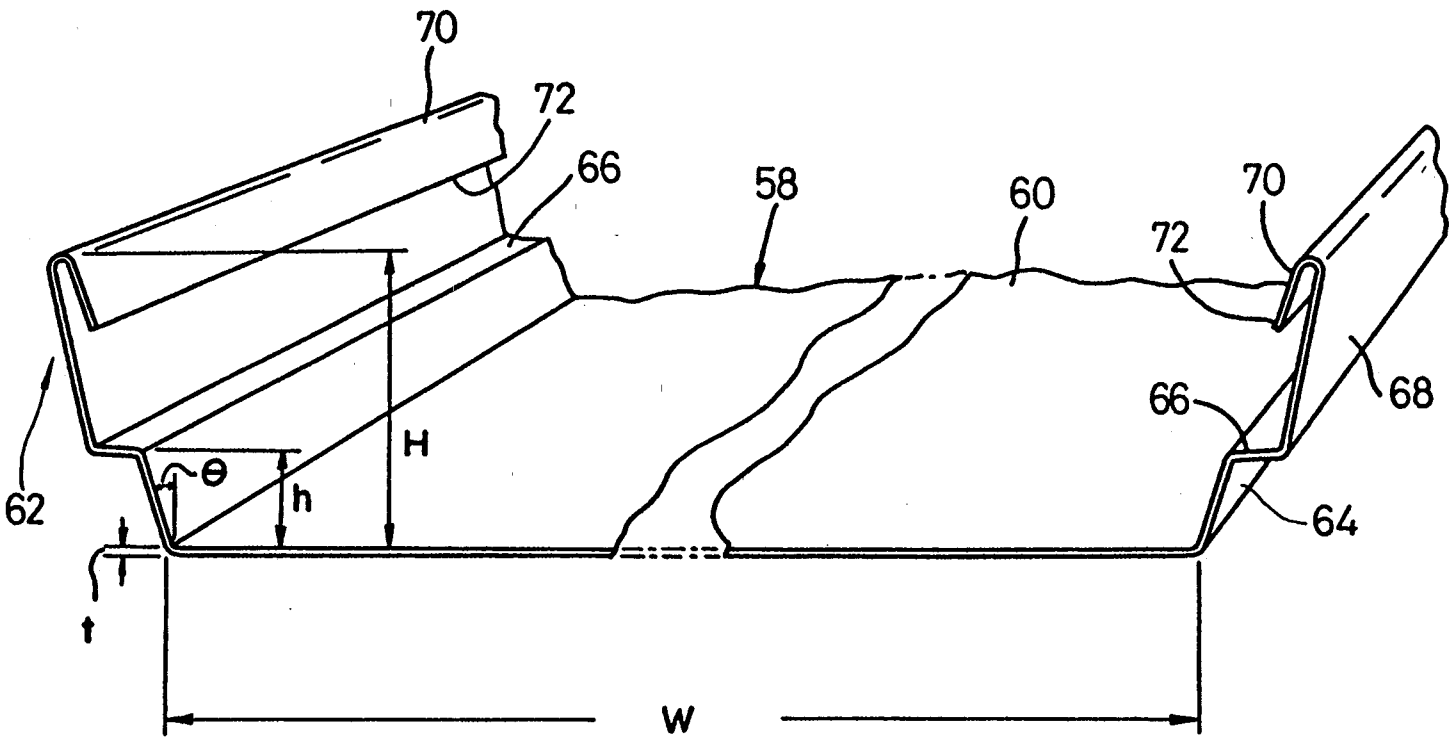
FIG. 6 is a partly cut-away perspective view of the roof plate shown in FIG. 5.

The roof plate for longitudinal roofing of the illustrated embodiment briefly described above is generally designated at reference numeral 58. The roof plate 58 is formed in a substantially laterally symmetric manner as shown in FIG. 5 and into a predetermined length of, for example, 3 to 5 m in the longitudinal direction. A plurality of the roof plates 58 thus formed are connected to each other in order in the longitudinal and lateral directions for the purpose of assembling a roof structure. Each of the roof plates 58, as shown in FIGS. 5 and 6, includes a plate body 60 which may be substantially flat, and lateral rising connection sections 62 formed on both lateral ends of the plate body 60. The plate body 60 of the roof plate 58 includes both longitudinal connection sections 63 which comprises an eaves side connection section 63A formed at an eaves side end portion of the plate body 60 and a ridge side connection section 63B formed at a ridge side end portion of the plate body 60.

The lateral rising connection sections 62 each include a first rising portion 64 formed so as to upwardly outwardly extend at an oblique angle of Θ from each of both lateral ends of the plate body 60, a horizontal portion 66 formed so as to horizontally outwardly extend from an upper end of the first rising section 64, and a second rising portion 68 formed so as to upwardly outwardly extend from an outer end of the horizontal portion 66. The horizontal portion 66 acts as a step for connecting the first rising portion 64 and second rising portion 68 to each other therethrough. The second rising portion 68 is inwardly folded at an upper end thereof to form a water sealing portion 70 in which a gap is defined and which includes a lower distal end 72.

The roof plate 58 may be so formed that the plate body 60 has a thickness t between about 0.4 mm to about 1.2 mm, a longitudinal length L of about 5 m and a lateral width W of 276 to 411 mm and each of the lateral connection sections has a height H of 30.0 mm. The first rising portion 64 may be formed into a height h about one third as large as the height H of the whole lateral connection section 62 or less and of 8 mm or more.

Also, the second rising portion 68 of each of the lateral connection sections 62 of the roof plate 58 is formed on each of both longitudinal sides of an upper end thereof with a cutout 74A (74B) by cutting both longitudinal end portions of the water sealing portion 70. The eaves side cutout 74A may be formed into a length of, for example, 50 to 100 mm and so as to be horizontal or downwardly oblique toward an eaves side end thereof, whereas the ridge side cutout 74B may be formed at a position of about 2 to 3 mm below an upper end of the second rising portion 70.

In each of both lateral connection sections 62 of the roof plate 58 constructed as described above, as shown in FIG. 2, the horizontal portion or step 66 through which the first and second rising portions 64 and 68 are connected to each other is supported on the shoulder 40 of the flat top portion 30 of the lower fixture 22 and the second rising portion 68 is supportedly abutted on an outer surface thereof against the projection 38 provided on the flat top 30. The stopper 36 provided on the inner surface of each of the holders 34 is engagedly fitted in the recess 48 formed on the outer surface of each of the held members 46 of the upper fixture 24.

The horizontal portion or step 66 of each of the lateral connection sections 62 of the roof plate 58 thus supported on the shoulder 40 is then downwardly pressed by the abutment 52 of each of the leg portions 50 of the fixture body 44 of the upper fixture 24, resulting in pressedly interposed between the shoulder 40 of the lower fixture 22 and the abutment 52 of the upper fixture 24. Thus, it will be noted that the lateral connection section 62 is pressedly interposedly supported between the lower fixture 22 and the upper fixture 24. The lower end 72 of the water sealing portion 70 is supportedly held on the inward projection 54 of each of the leg portions 50 of the fixture body 44 of the lower fixture 22.

Thus, the roof plates 58 for longitudinal roofing which are arranged laterally adjacent to each other are laterally securely connected through the fixture combination 18 or the lower and upper fixtures 22 and 24, as shown in FIG. 2.

The eaves side connection section 63A of the longitudinal connection sections 63 of the plate body 60 of the roof plate 58, as shown in FIG. 1, includes an eaves side engagement portion 76 formed by downwardly folding the eaves side end portion of the flat plate body 60 in a hairpin-like manner. This results in a gap being formed in the eaves side engagement 76. The eaves side engagement 76 may be formed into a length of 10 to 20 mm and so as to permit the gap to have a size of 1.5 to 2.0 mm. The ridge side connection section 63B of the flat plate body 60, as shown in FIGS. 1 and 5, includes a downwardly oblique portion 78 formed so as to downwardly obliquely extend in a ridge side direction from the flat plate body 60 and a support portion 80 which is formed at a distal end of the oblique portion 78 so as to longitudinally outwardly extend in a ridge side direction therefrom and on which the eaves side engagement portion 76 of the eaves side connection section 63A of upper or ridge-side one of the roof plates 58 longitudinally adjacent to each other is laid or supported. The oblique portion 78, as shown in FIG. 5, is so formed that both lateral ends thereof each extend to the second rising portion 68 of each of the lateral connection sections 62 of the roof plate 58.

The support portion 80 of the ridge side connection section 63B, as shown in FIGS. 1 and 5, is formed at a portion thereof beyond the eaves side connection portion 76 of upper or ridge-side one of the longitudinally adjacent roof plates 58 with a plurality of laterally extending strip-like projections 82 and at a distal end thereof with a strip-like raised portion 84. The strip-like projections 82 and raised portion 84 are arranged so as to laterally extend to the second rising portion 68 of each of the lateral connection sections 62 and be spaced in parallel from each other at suitable intervals in the longitudinal direction of the flat plate body 60. In the illustrated embodiment, the projections 82 are formed into a trapezoidal shape in section. Alternatively, they may be formed into an inverted V-shape or the like. Also, the strip-like projections 82 and/or raised portion 84 each may be so formed that an upper surface thereof is positioned below an upper surface of the flat plate body 60. Further, in the illustrated embodiment, the strip-like projections 82 each are formed with at least one discontinuity 86. The discontinuities 86 of the projections 82 are positioned so as not to positionally correspond to or align with each other.

Figure 7:
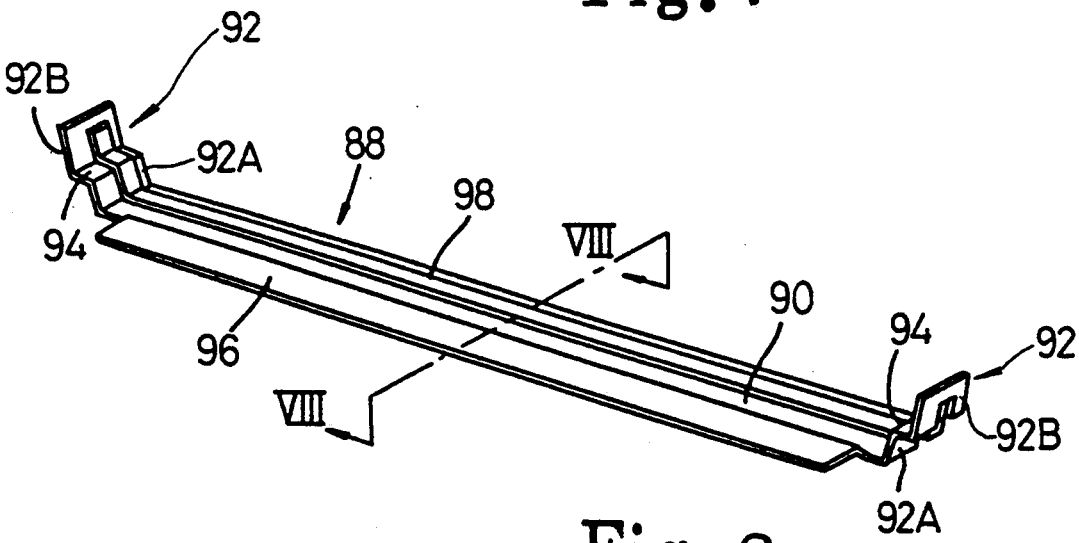
FIG. 7 is a perspective view showing a joint used for longitudinally connecting rood plates to each other.
Figure 8:
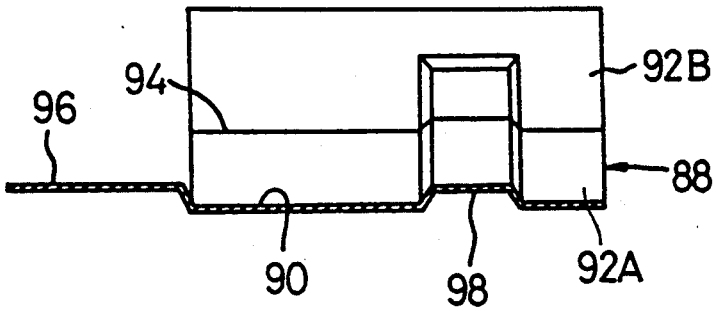
FIG. 8 is a sectional view taken along line VIII—VIII of FIG. 7.

The roof plates 58 longitudinally adjacent to each other may be longitudinally connected through the thus formed longitudinal connection sections 63 by means of a joint 88. The joint 88, as shown in FIGS. 1, 7 and 8, is formed so as to be substantially laterally symmetric and into substantially the same shape as a cross section of the roof plate 58. More particularly, the joint 88 is formed into substantially the same side configuration as a cross section of the support portion of the ridge side connection section. Thus, the joint 88 includes an elongated joint body 90 formed so as to laterally extend, and a lateral rising section 92 formed on each of both lateral ends of the joint body 90. The lateral rising section 92 includes a lower or first rising portion 92A and an upper or second rising portion 92B. The first and second rising portions 92A and 92B are connected to each other through a horizontal portion or step 94 formed so as to outwardly extend between an upper end of the first rising portion 92A and a lower end of the second rising portion 92B.

Figure 9:
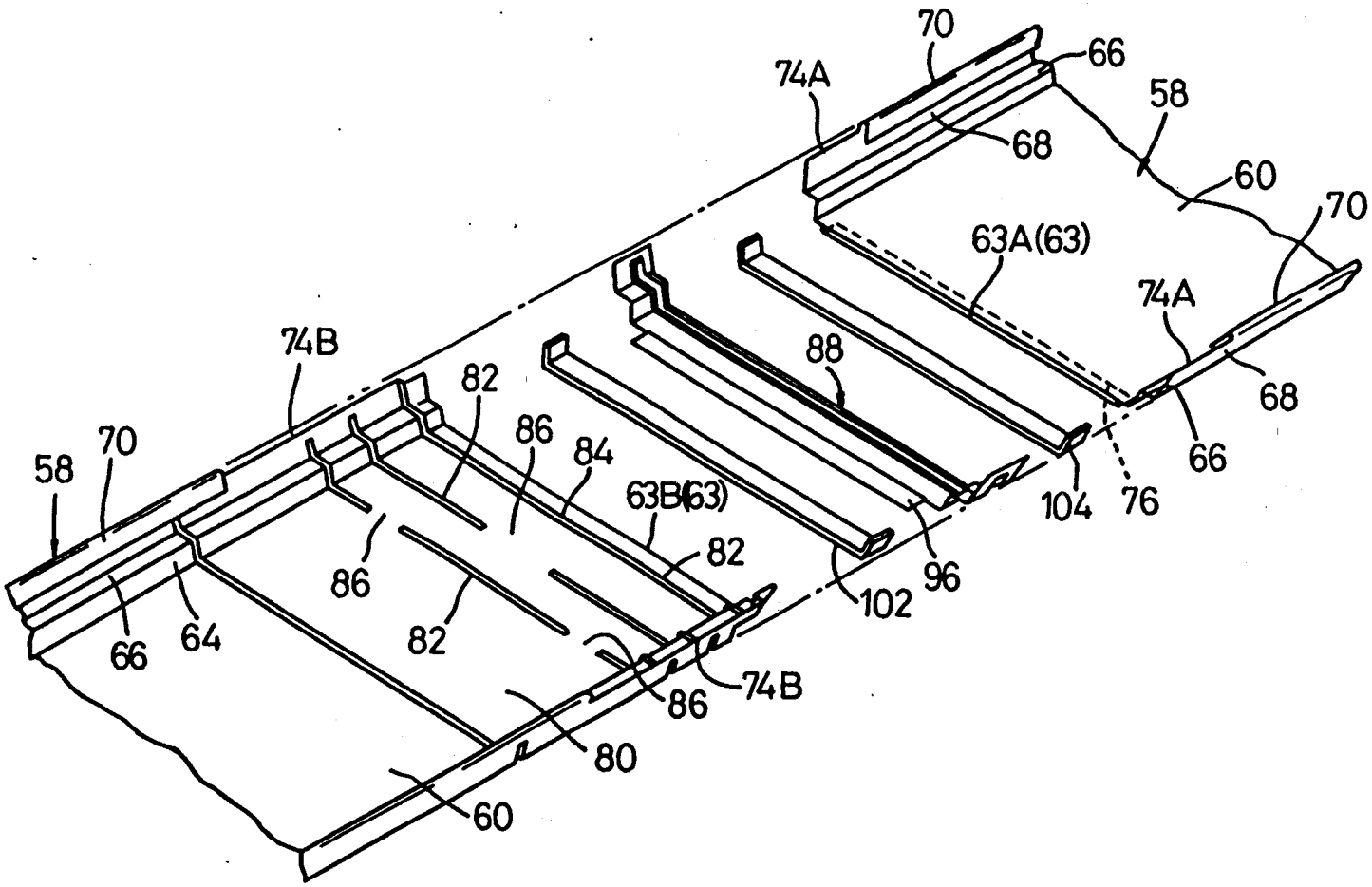
FIG. 9 is a fragmentary exploded perspective view showing a longitudinal connection region between longitudinally adjacent roof plates of the present invention.

The joint 88, as shown in FIGS. 1 and 9, is arranged on the support portion 80 of the ridge side connection section 63B of the flat plate body 60 of the roof plate 58 and positioned on the support portion 80 by inserting an upper end of each of the second rising portions 92B of the joint 50 into the above-described gap defined in the water sealing portion 70 of the corresponding lateral connection section 62 of the roof plate 58. Then, the joint 88 is fixed on the roof plate 58 using any suitable means such as adhesion, spot welding or the like. The joint 88 is formed on an eaves side end thereof with an engagement portion 96 in a manner to longitudinally outwardly extend therefrom. The engagement portion 96 of the joint 88 is adapted to be engagedly fitted in the eaves side engagement portion 76 of the eaves side connection section 63A of upper or ridge-side one of the longitudinally adjacent roof plates 58 to be connected to each other, as shown in FIG. 1. Further, the joint body 90 of the joint 88 is provided thereon with a reinforcing rib 98 in a manner to laterally continuously extend between both second rising portions 92B.

Thus, longitudinal connection between the roof plates longitudinally adjacent to each other, as shown in FIGS. 1 and 9, may be carried out by fixedly mounting the joint 88 on the support portion 80 of lower or eaves-side one of the adjacent roof plates 58 and then engagedly inserting the engagement portion 96 of the joint 88 into the eaves side engagement portion 76 of upper or ridge-side one of the adjacent roofs 58. The joint 88 may be previously mounted on the roof plate 58. This permits the joint 88 to be integrated with the roof plate 58, to thereby more facilitate the assembling operation.

The roof plate 30, as shown in FIG. 1, may be mounted on a lower surface thereof with a heat insulating material 100 such as polyethylene foam or the like by, for example, adhesion. Reference numerals 102 and 104 each designate a waterstop made of rubber or the like and arranged on each of upper and lower surfaces of the joint 88. The waterstops 102 and 104 each are so formed that each of both lateral ends thereof is raised, resulting in being tightly abutted against each of inner and outer surfaces of each of the first and second rising portions 92A and 92B of the joint 88.

Now, lateral connection between the roof plates for longitudinal roofing will be described hereinafter.

First, as shown in FIG. 2, the lateral connection sections 62 of the laterally adjacent roof plates for longitudinal roofing are connected to each other through the fixture combination 18 in such a manner that each of the horizontal portions or steps 66 of the adjacent roof plates through which the first and second rising portions 64 and 68 are connected to each other is supported on each of the opposite shoulders 40 of the lower fixture 22 and the second rising portion 68 is supportedly abutted on the outer surface thereof against each of the opposite projections 38 provided on the flat top portion 30 of the lower fixture 22.

Then, the upper fixture 24 is fitted on the lower fixture 22. This causes in the horizontal portion or step 66 thus supported on each of the opposite shoulders 40 of the lower fixture 22 to be downwardly pressed by the abutment 52 of each of the opposite leg portions 50 of the fixture body 44 of the upper fixture 24, resulting in each of the steps 66 being pressedly interposed between the shoulder 40 of the lower fixture 22 and the abutment 52 of the upper fixture 24. Thus, the lateral connection section 62 of each of the laterally adjacent roof plates 58 is pressedly interposedly supported between the lower fixture 22 and the upper fixture 24, as shown in FIG. 2. The lower end 72 of the water sealing portion 70 of the lateral connection section 62 of each of the adjacent roof plates 58 is supportedly held on the inward projection 54 of each of the opposite leg portions 50 of the fixture body 44 of the upper fixture 24. Such lateral connection between the laterally adjacent roof plates is repeated for the purpose of assembling a roof.

Reference numeral 106 designates a cover member for protecting a lateral connection region of the adjacent roof plates thus laterally connected to each other. In the illustrated embodiment, the cover member 106, as shown in FIGS. 2 and 3, is formed into a substantially inverted U-shape in section and the same longitudinal dimension or length as the roof plate element. The cover member 106 is inwardly folded at a distal end of each of leg portions thereof except a part thereof on a ridge side 108B of the cover member, resulting in a locking portion 110 being provided as shown in FIGS.

2, 10 and 11. The locking portions 110 each are adapted to be elastically engagedly fitted in the groove 56 formed at each of the leg portions 50 of the upper fixture 24.

Figure 10:
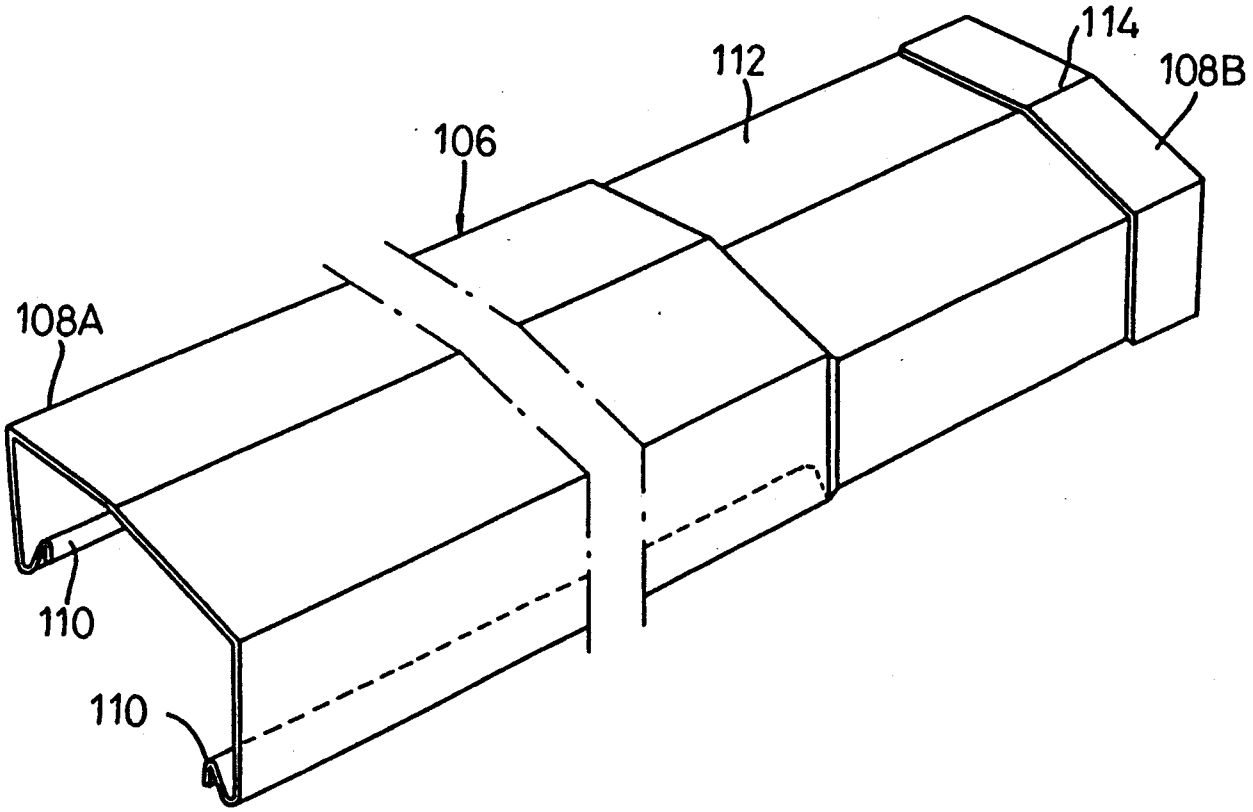
FIG. 10 is a partly cutaway perspective view showing a cover for protecting a lateral connection region between the roof plates laterally adjacent to each other.
Figure 11:
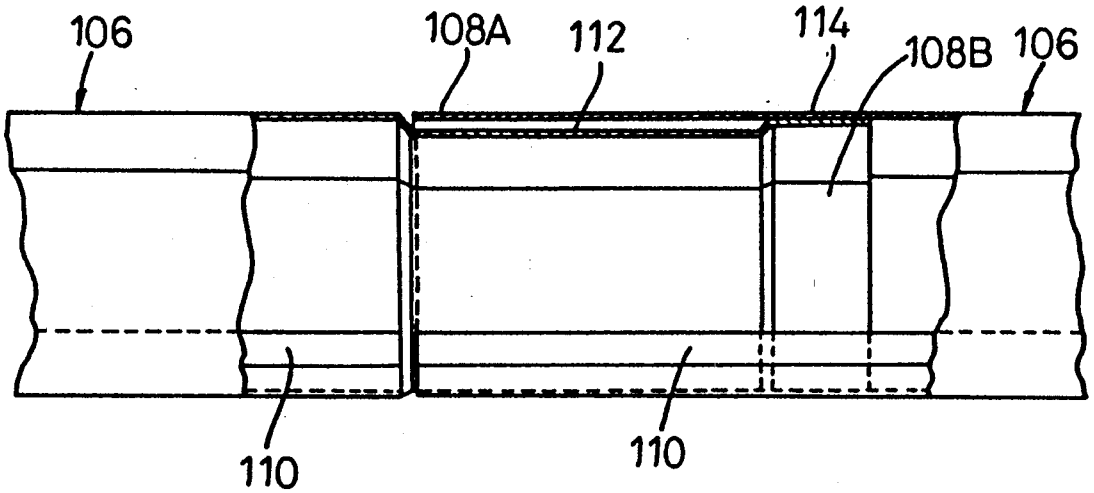
FIG. 11 is a fragmentary sectional view showing connection between the covers of FIG. 10 arranged longitudinally adjacent to each other.

The cover member 106, as shown in FIG. 10, is formed on the ridge side 108B thereof with an overlap region 112, which is formed at an end of a ridge side thereof with a strip-like raised portion 114. On the overlap region 112 and raised portion 114 thus formed, an eaves side 108A of an upper adjacent cover member 106 is flash overlapped as shown in FIG. 11.

Figure 12:
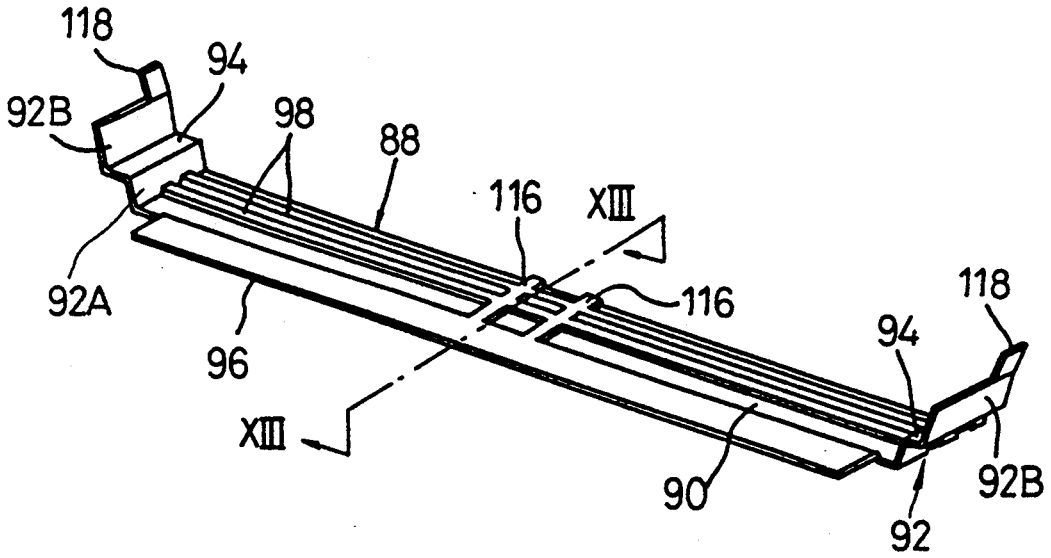
FIG. 12 is a perspective view showing a modification of the joint shown in FIG. 7.
Figure 13:
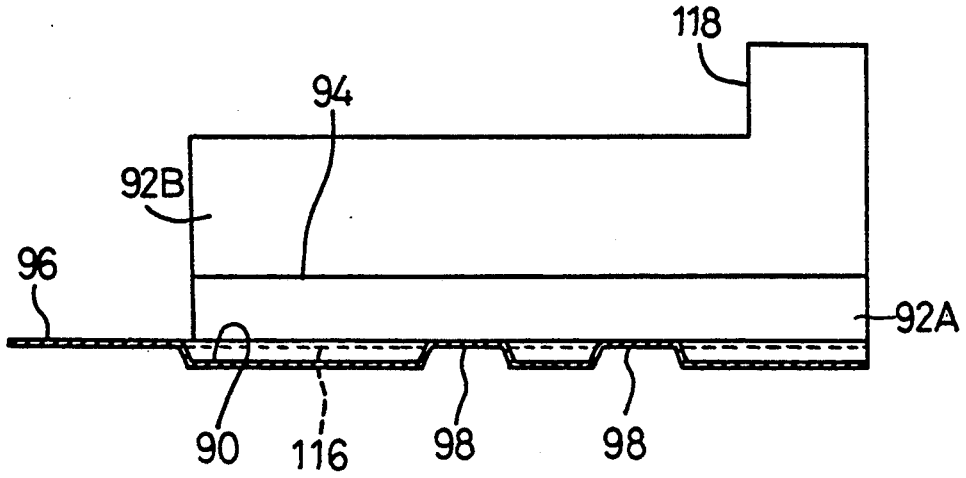
FIG. 13 is a sectional view taken along line XIII—XIII of FIG. 12.

Referring now to FIGS. 12 and 13, a modification of the joint 88 described above with reference to FIGS. 7 and 8 is illustrated. A joint 88 shown in FIGS. 12 and 13 is constructed in such a manner that a joint body 90 is provided at a central portion of a rear surface thereof with a pair of drainage grooves 116 extending in a direction perpendicular to a longitudinal direction of the joint 88 or in a longitudinal direction of the roof plate 58 in a manner to be positionally symmetric to each other. The drainage grooves 116 each act to outwardly drain rainwater entering the joint 88 or water condensed at the joint therethrough. The grooves 116 each are formed so as to extend at an eaves side end thereof to an engagement portion 96 to reinforce it.

Figure 14:
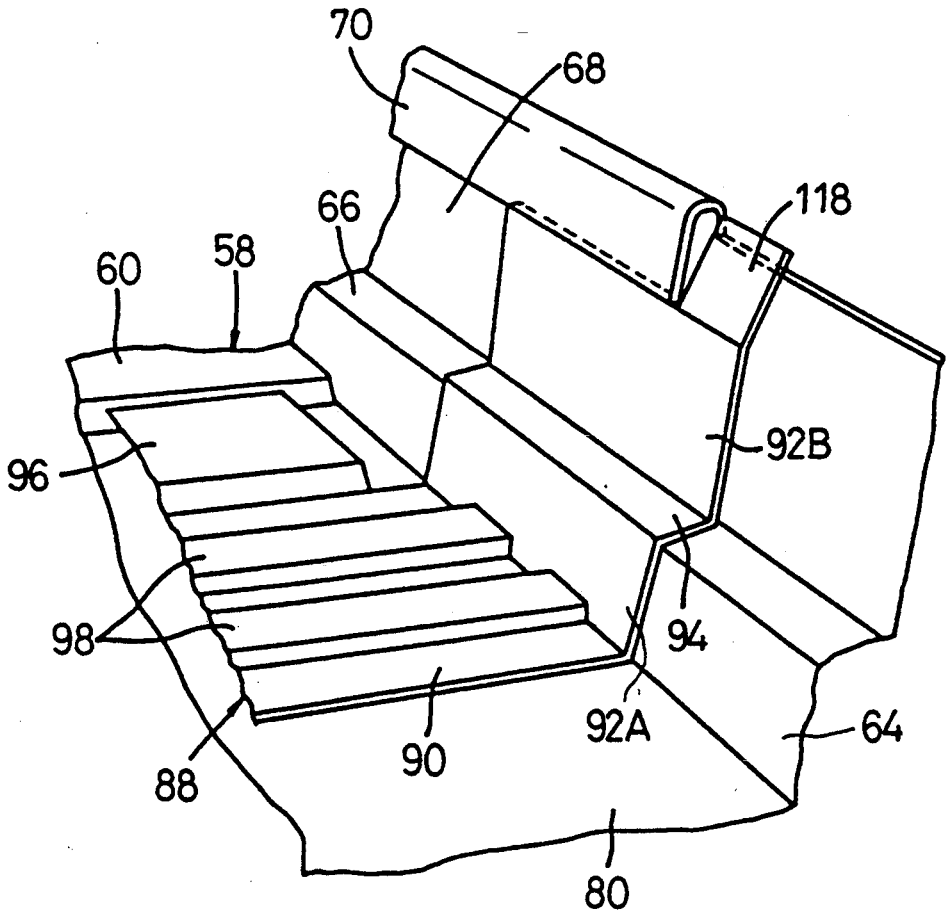
FIG. 14 is a fragmentary perspective view showing arrangement of the joint of FIG. 12 with respect to a roof plate for longitudinal roofing.

Reference numeral 118 designates a positioning member 118 formed on an upper end of each of both second rising portions 92B of the joint 88 so as to upwardly project therefrom. Each of the positioning members 118, as shown in FIG. 14, is heldly abutted against an end surface of the water sealing portion 70 of the second rising portion 68 of each of the lateral connection sections 62 of the roof plate 58 to facilitate positioning of the joint 88 with respect to the roof plate 58. The remaining part of the joint 88 shown in FIG. 12 may be constructed in substantially the same manner as the joint shown in FIG. 7.

Figure 15:
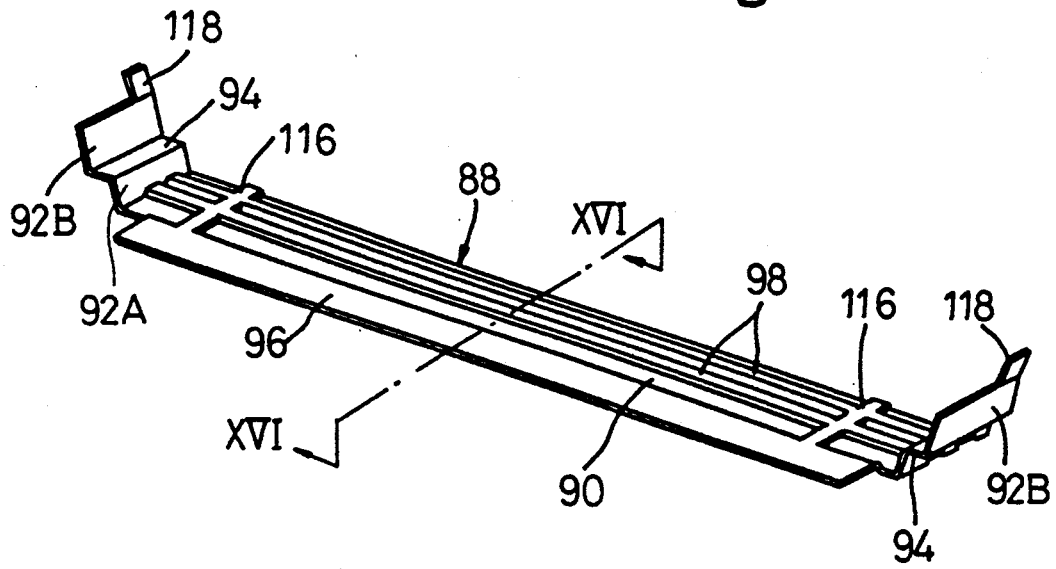
FIG. 15 is a perspective view showing another modification of the joint shown in FIG. 7.
Figure 16:
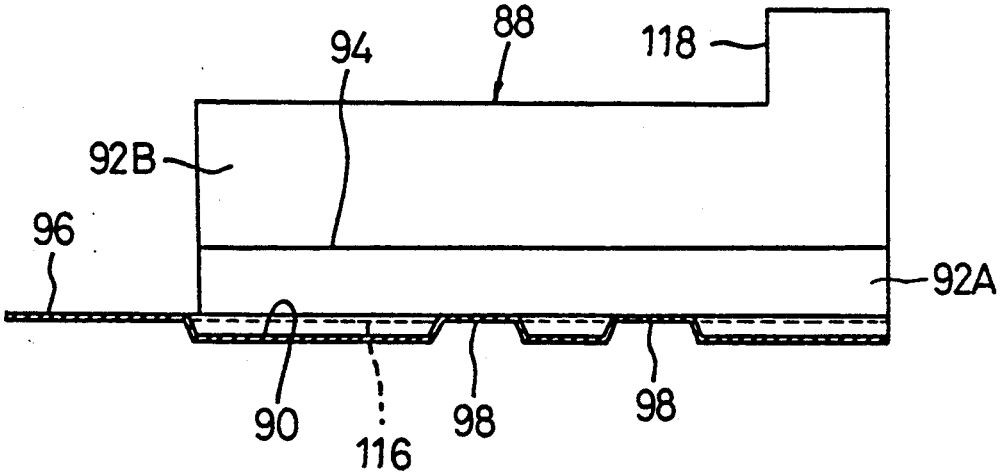
FIG. 16 is a sectional view taken along line XVI—XVI of FIG. 15.

FIGS. 15 and 16 show another modification of the joint 88 shown in FIGS. 7 and 8, wherein drainage grooves 116 are arranged so as to be spaced from each other at a large distance as compared with the joint shown in FIG. 12. The remaining part of the joint shown in FIG. 15 may be constructed in substantially the same manner as that shown in FIG. 15.

Figure 17:
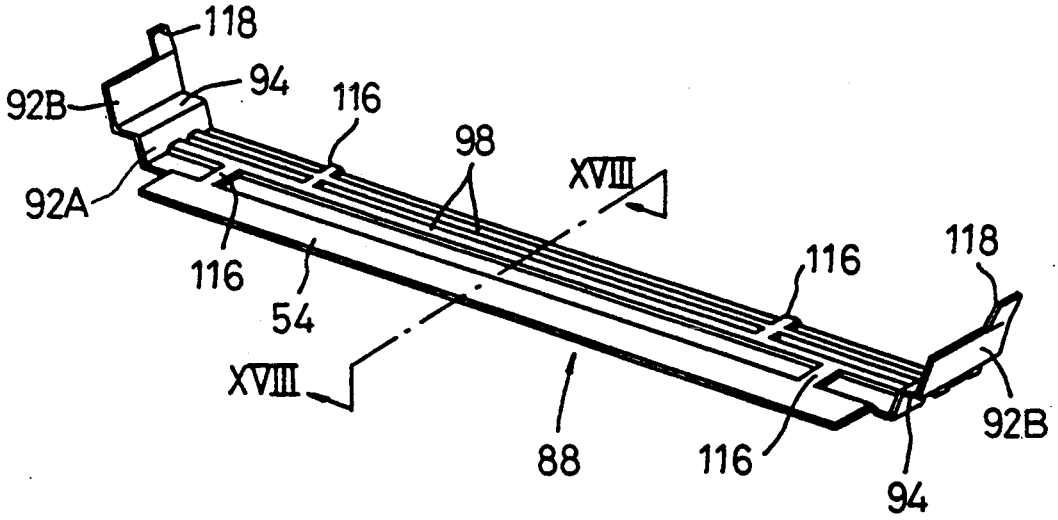
FIG. 17 is a perspective view showing a further modification of the joint shown in FIG. 7.
Figure 18:
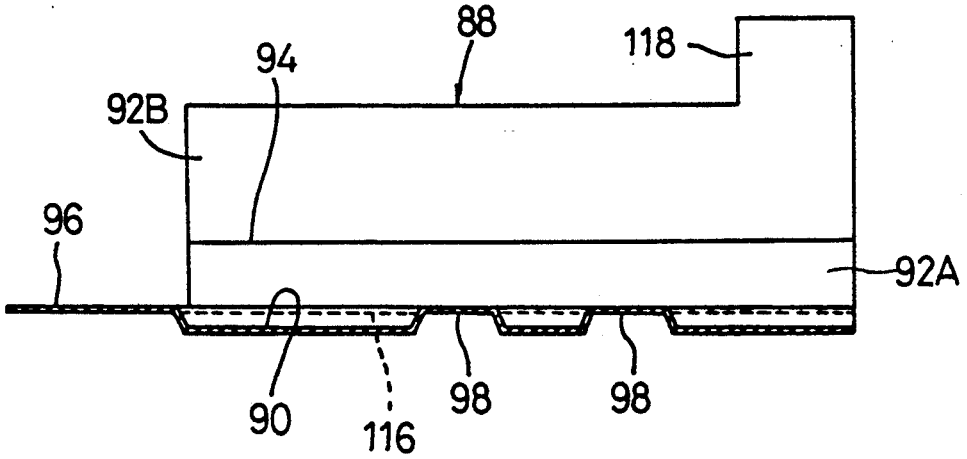
FIG. 18 is a sectional view taken along line XVIII—XVIII of FIG. 17.

FIGS. 17 and 18 show a further modification of the joint 88 shown in FIGS. 7 and 8, wherein drainage grooves 116 each are formed stepwise in a horizontal direction. The remaining part of the modification may be constructed in substantially the same manner as the joint shown in FIGS. 15 and 16.

Figure 19:
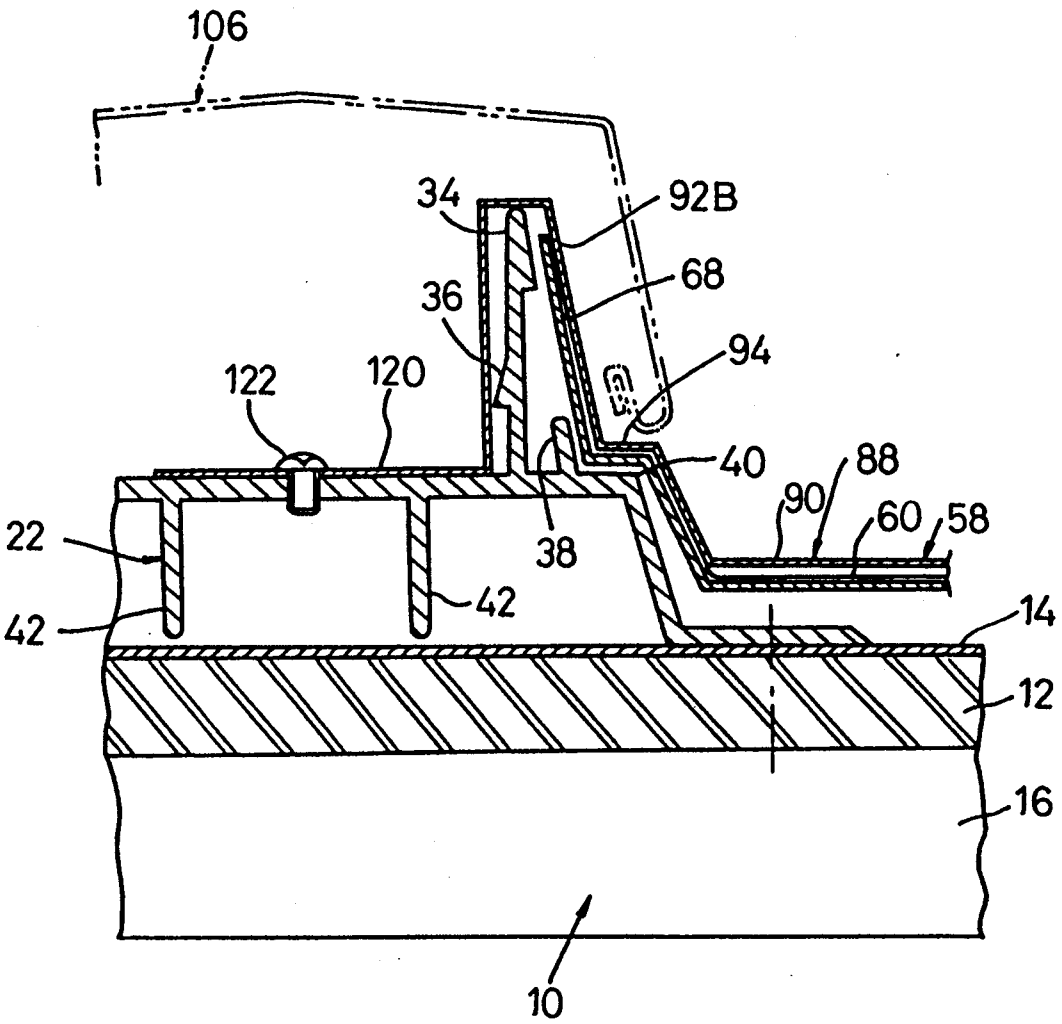
FIG. 19 is a fragmentary vertical sectional view showing fixing of still another modification of the joint shown in FIG. 17 with respect to a lateral connection section of a roof plate for lateral roofing according to the present invention.

FIG. 19 shows an essential part of still another modification of the joint 88. In a joint 88 of the modification, second rising portions 92B each are formed with an extension 58 which outwardly extends beyond the second rising portion 68 of each of the lateral connection sections 62 of the roof plate 58. The extension 120 is fixed on the lower fixture 22 using any suitable securing means such as a bolt or the like, to thereby secure the joint 88 with respect to the fixture combination and roof plate.

As can be seen from the foregoing, in the longitudinally assembled roof structure of the present invention, the roof plates each include the plate body, the lateral rising connection sections provided on both lateral sides of the plate body and the longitudinal connection sections provided on both longitudinal ends of the plate body, wherein the longitudinal connection sections include the eaves side connection section and the ridge side connection section. The ridge side connection section includes the downwardly oblique portion and the support portion extending in the ridge side direction from the downwardly oblique portion, and the eaves side connection section includes the engagement portion formed by downwardly folding the eaves side end of the plate body and adapted to be overlapped on the support portion of the ridge side connection section of the roof plate adjacent in the eaves side direction of the roof structure. Also, the joint includes the engagement portion formed so as to be engageable with at least the engagement portion of the eaves side connection section of the plate body and the cover member is provided on the ridge side thereof with the overlap portion. The joint is arranged on the support portion of the ridge side connection section of the plate body and engaged at the engagement portion thereof with the engagement portion of the ridge side connection section of the roof plate adjacent in the ridge side direction of the roof structure. The cover members longitudinally adjacent to each other are connected through the overlap portions thereof to each other in turn in the longitudinal direction.

Such construction permits the connection regions between the roof plates of the assembled roof structure to exhibit increased strength against a wind pressure, resulting in wind from lifting the roof plate through the connection regions. Also, it effectively prevents rainwater from entering the connection regions due to a capillary action or the like, to thereby improve watertightness and durability of the roof structure. Also, the above-described construction of the present invention effectively prevents strong wind from tearing up the roof plates, to thereby enhance durability of the roof structure. Further, the present invention eliminates a necessity of forming the roof plates and joints at a roof assembling site, to thereby improve the workability.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A method for making a longitudinally assembled roof structure comprising steps of:

arranging a plurality of roof plates adjacent to each other in at least a longitudinal direction on a backing member;

the roof plates each being formed into a predetermined length in a longitudinal direction of the roof structure and including a plate body, lateral rising connection sections provided on both lateral sides of the plate body and longitudinal connection sections provided on both longitudinal ends of the plate body;

the longitudinal connection sections including an eaves side connection section and a ridge side connection section;

the ridge side connection section including a downwardly oblique portion and a support portion extending in a ridge side direction from the downwardly oblique portion;

the eaves side connection section including an engagement portion formed by downwardly folding an eaves side end of the plate body and adapted to be overlapped on the support portion of the ridge side connection section of the roof plate adjacent in an eaves side direction of the roof structure;

positioning a joint on the support portion of the ridge side connection section of ridge side one of each longitudinally adjacent two roof plates;

the joint including an engagement portion adapted to be engageable with at least the engagement portion of the eaves side connection section of the roof plate;

engaging the engagement portion of the join with the engagement portion of the eaves side connection section of ridge side one of each longitudinally adjacent two roof plates; and putting cover members on lateral connection regions between the roof plates laterally adjacent to each other;

said cover members each being provided on a ridge side thereof with an overlap portion; and connecting said cover members to each other through the overlap portions in the longitudinal direction.

2. A method as defined in claim 1, wherein said joint is previously mounted on said roof plate.

3. A longitudinally assembled roof structure comprising:

a plurality of roof plates each formed into a predetermined length in a longitudinal direction of the roof structure;

a joint for connecting each longitudinally adjacent two of said roof plates to each other;

each laterally adjacent two of said roof plates being laterally connected to each other through a connection region defined therebetween; and cover members put on said connection regions between said roof plates laterally adjacent, respectively, and adapted to be longitudinally connected to each other;

said roof plates each including a plate body, lateral rising connection sections provided on both lateral sides of said plate body and longitudinal connection sections provided on both longitudinal ends of said plate body;

said longitudinal connection sections including an eaves side connection section and a ridge side connection section;

said ridge side connection section including a downwardly oblique portion and a support portion extending in a ridge side direction from said downwardly oblique portion;

said eaves side connection section including an engagement portion formed by downwardly folding an eaves side end of said plate body and adapted to be overlapped on the support portion of the ridge side connection section of the roof plate adjacent in an eaves side direction of the roof structure;

said joint including an engagement portion formed so as to be engageable with at least said engagement portion of said eaves side connection section of said plate body;

said cover member being provided on a ridge side thereof with an overlap portion;

said joint being arranged on said support portion of said ridge side connection section of said plate body and engaged at said engagement portion thereof with the engagement portion of the ridge side connection section of the roof plate adjacent in a ridge side direction of the roof structure;

said cover members longitudinally adjacent to each other being connected through said overlap portions thereof to each other in turn.

4. A longitudinally assembled roof structure as defined in claim 3, wherein said engagement portion of said eaves side connection section is folded so as to define a gap therein.

5. A longitudinally assembled roof structure as defined in claim 3, wherein said engagement portion of said joint is inserted into said gap of said engagement portion of said eaves side connection section.

6. A longitudinally assembled roof structure as defined in claim 3, wherein said joint is formed into substantially the same side configuration as a cross section of said support portion of said ridge side connection section of said roof plate.

7. A longitudinally assembled roof structure as defined in claim 6,, wherein said joint includes an elongated joint body formed so as to laterally extend, and a lateral rising section formed on each of both lateral ends of said joint body.

8. A longitudinally assembled roof structure as defined in claim 7, wherein said lateral rising section includes a first rising portion and a second rising portion upwardly extending from said first rising portion.

9. A longitudinally assembled roof structure as defined in claim 8, wherein said first and second rising portions are connected to each other through a horizontal portion formed so as to outwardly extend between an upper end of said first rising portion and a lower end of said second rising portion.

10. A longitudinally assembled roof structure as defined in claim 7, wherein said joint further includes a positioning member provided on said lateral rising section.

11. A longitudinally assembled roof structure as defined in claim 7, wherein said joint further includes an extension formed so as to outwardly extend beyond each of said lateral connection sections of said roof plate and fixed with respect to said roof plate.

12. A longitudinally assembled roof structure as defined in claim 7, wherein said joint body of said joint is provided thereon with a reinforcing rib in a manner to laterally continuously extend between both lateral rising sections of said joint.

13. A longitudinally assembled roof structure as defined in claim 7, wherein said joint body is provided at a central portion of a rear surface thereof with a pair of drainage grooves extending in a direction perpendicular to a longitudinal direction of said joint in a manner to be positionally symmetric to each other.

14. A longitudinally assembled roof structure as defined in claim 7, wherein said drainage grooves each are formed stepwise in a horizontal direction.

* * * * *